United States Patent [19]

Martens et al.

[11] 4,148,650

[45] Apr. 10, 1979

[54] INSTANT PROCESSING FILM UNIT WITH INTERNAL DARK SLIDE AND LIGHT SEAL

[75] Inventors: Richard H. Martens; Charles J. Simpson, both of Greece, N.Y.

[73] Assignee: Eastman Kodak Company, Rochester, N.Y.

[21] Appl. No.: 834,588

[22] Filed: Sep. 19, 1977

[51] Int. Cl.[2] ..... G03C 1/48; G03D 9/02

[52] U.S. Cl. ..... 96/76 C; 334/304

[58] Field of Search ..... 96/76 R, 76 C, 67; 354/304

[56] References Cited

U.S. PATENT DOCUMENTS

| | | | |
|---|---|---|---|
| 2,740,714 | 6/1951 | Bachelder et al. | 96/76 C |
| 3,053,160 | 9/1962 | Bachelder et al. | 96/76 C |
| 3,854,812 | 12/1974 | Sorli | 354/312 |
| 4,042,395 | 8/1977 | Tone et al. | 96/76 C |

*Primary Examiner*—Richard Schilling
*Attorney, Agent, or Firm*—J. A. Matthews

[57] ABSTRACT

A preregistered, instant-processing film unit including an internal dark slide removeable from an end section of the unit and a light seal for preventing daylight fogging of the unit from said end section. The film unit includes a photosensitive element for recording a processable latent image. A cover sheet is connected to the photosensitive element and the dark slide is removeably positioned between the element and sheet. The light seal includes a strip coupled to the photosensitive element and folded into the dark slide so that the strip is released by the act of removing the dark slide.

7 Claims, 13 Drawing Figures

INSTANT PROCESSING FILM UNIT WITH INTERNAL DARK SLIDE AND LIGHT SEAL

CROSS-REFERENCE TO RELATED APPLICATIONS

Reference is made to commonly assigned, copending U.S. patent applications Ser. No. 834,589 entitled INSTANT PROCESSING FILM UNIT HAVING INTERNAL DARK SLIDE filed in the name of Wayne A. Bubb; Ser. No. 834,617 entitled INSTANT PROCESSING FILM UNIT filed in the name of Robert A. Sylvester; and Ser. No. 834,590 entitled PHOTOGRAPHIC FILM UNIT filed in the name of William H. Johnson, all filed on even date herewith.

BACKGROUND OF THE INVENTION

The present invention relates to instant-processing film units suitable for daylight handling both before and after exposure. More specifically, the invention relates to such film units having an internal dark slide which is removeable from one end of the unit, and means for establishing a light seal between the dark slide and the film unit at such end, which light seal does not interfere significantly with the removal of the dark slide.

In cross-referenced U.S. patent application Ser. No. 834,589, entitled INSTANT-PROCESSING FILM UNIT HAVING INTERNAL DARK SLIDE, a film unit is disclosed which is suitable for daylight handling on a one-shot or single film unit basis both before and after exposure in commercially available apparatus. The film unit includes a photosensitive element for recording a latent image, a cover sheet preregistered with the element for facilitating the distribution of a processing composition over the element, and an internal dark slide removeably positioned between the element and sheet for shielding the photosensitive element from premature exposure or fogging. In operation, the film unit is daylight loaded into the exposure apparatus and then the dark slide is removed so the film unit can be exposed in the usual manner.

Film units of the abovementioned type offer significant advantages over previously available approaches. They are suitable for pre-exposure as well as post-exposure daylight handling on an individual or one-shot basis, yet they are relatively simple in physical construction and are easy to use with commerically available exposing apparatus. It has been found, however, that under certain handling conditions, the photosensitive element may be fogged by light entering between that element and the cover sheet at an end section of the unit. When the film unit is handled by its leading end, or even by the dark slide itself, for example, the leverage of the respective film-unit elements may lift the slide from its protective position relative to the photosensitive element.

The light sealing problem is exacerbated by the fact that the seal should remain secure under possible adverse handling conditions until after the film unit is positioned in the exposure apparatus. It should be remembered that in such position the seal is inaccessible. Moreover, while the interface between the seal and the dark slide must be sufficiently intimate to block light, it should not significantly interfere with the intended removal of the dark slide.

SUMMARY OF THE INVENTON

In accordance with the present invention, an instant-processing film unit, having an internal dark slide, is provided with a relatively secure light seal which does not interfere significantly with the removal of the dark slide even though the seal may be inaccessible at the time of such removal.

The film unit includes a photosensitive element for recording a processable latent image, a cover sheet for facilitating the distribution of a processing composition over the element, and a removable dark slide positioned between the element and sheet to protect the photosensitive element from daylight fogging. The seal extends between the photosensitive element and the dark slide at the section of the film unit where the dark slide is intended to be removed and blocks light from exposing the photosensitive element through that section. In the preferred embodiment, the seal comprises an opaque strip which is adhered at one end to the photosensitive element and folded at the other end into the dark slide. When the dark slide is removed, it unfolds to release the opaque strip, which remains attached to the photosensitive element.

In accordance with one feature of the invention, the strip has a predetermined length, and is adhered to the photosensitive element at a position spaced by such length from the leading end of the element. Thus, when the strip is unfolded from the dark slide, it can lay flat against the photosensitive element without extending beyond its leading end.

In accordance with another feature, the strip in its folded or sealing condition is located within the confines of the photosensitive element and process sheet where its integrity is protected to some extent by the element and sheet.

In accordance with still another feature, the process sheet is secured to the photosensitive element in a manner that pinches or traps the folded strip between the element and sheet.

BRIEF DESCRIPTION OF THE DRAWINGS

In the detailed description of the preferred embodiment of the invention presented below, reference is made to the accompanying drawings in which.

Figure 1:
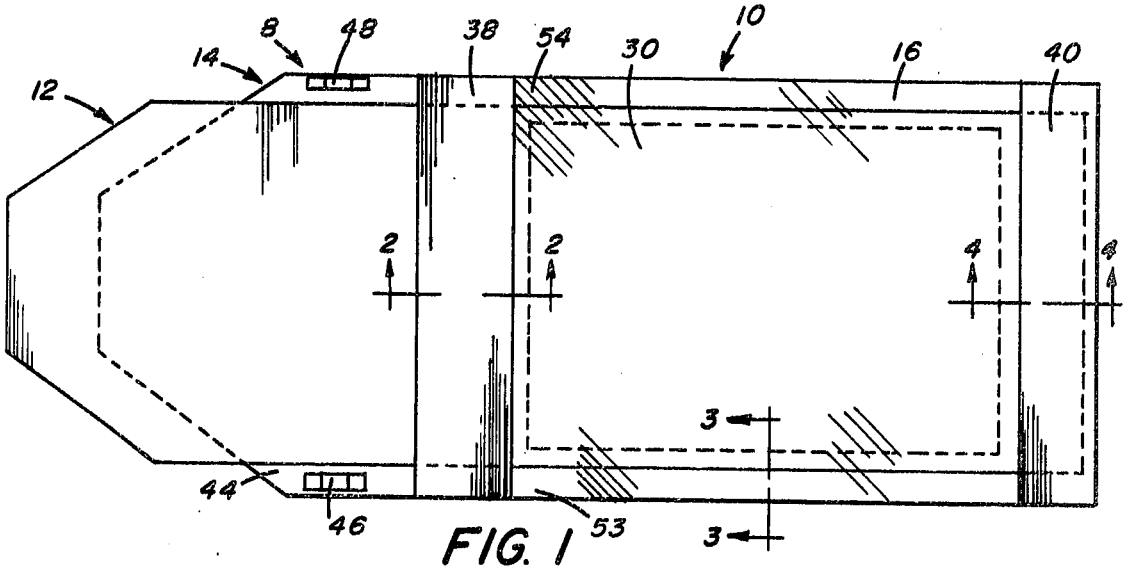
FIG. 1 is a plan view of a film unit in accordance with the preferred embodiment of the invention depicting its general features including the picture unit, dark slide, and leader.
Figure 6:
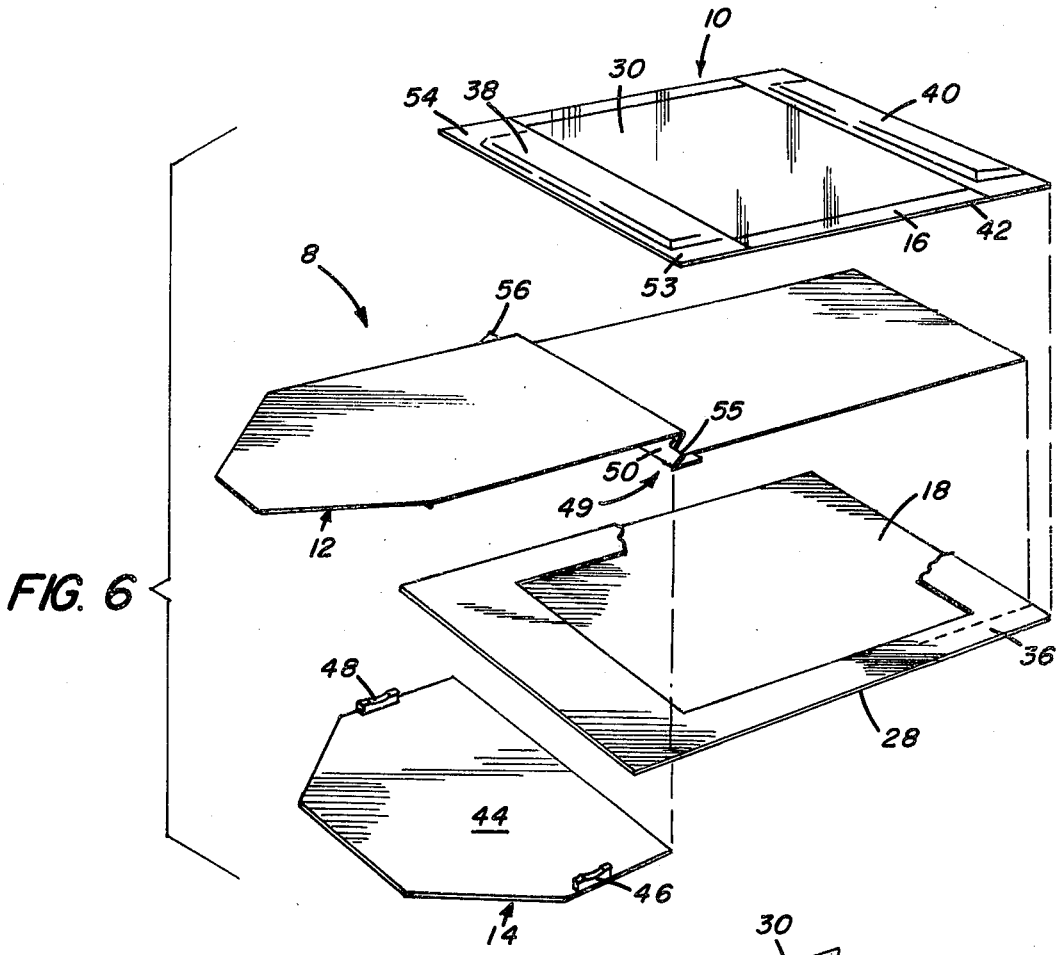
Figure 7:
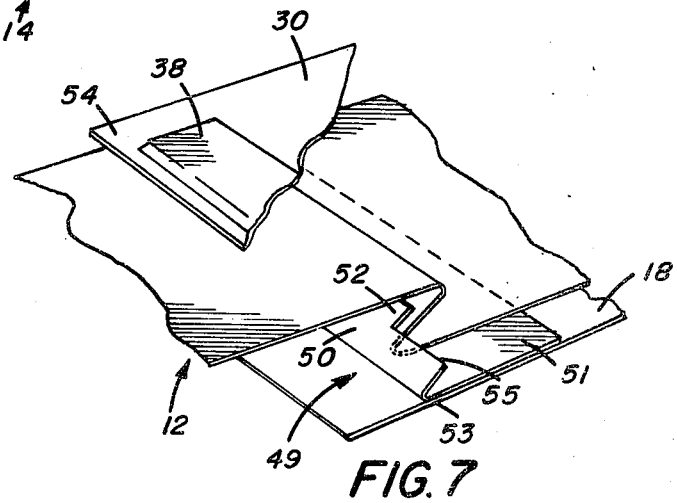
Figure 8:
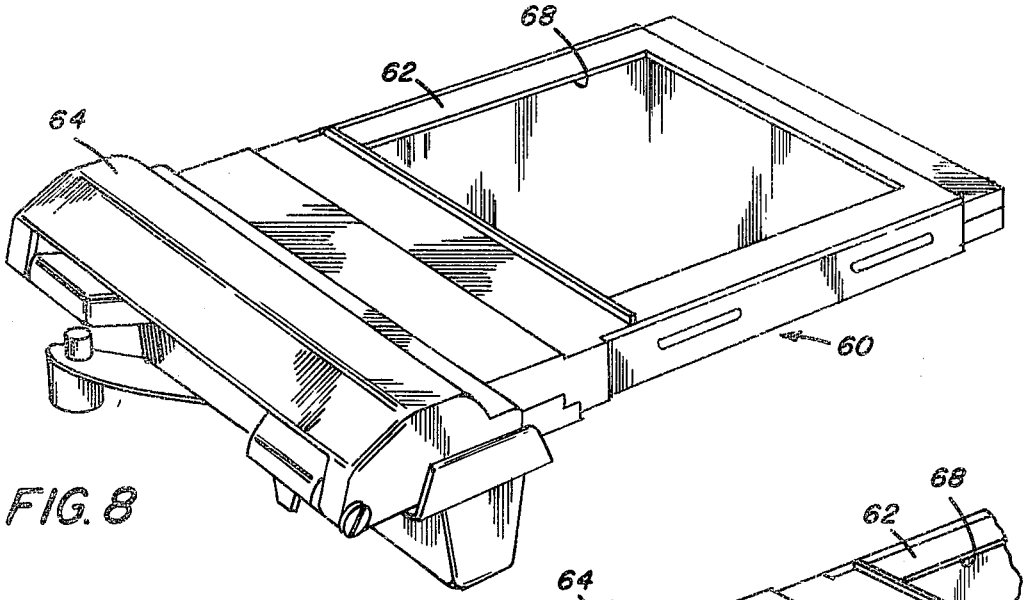

FIG, 5 is a cross-sectional view of the photosensitive element illustrating certain of its layers;

FIG. 6 is an exploded view of the film unit of FIG. 1;

FIG. 7 is an enlarged partial view of a light seal between the dark slide and film unit at the leading end thereof;

FIG. 8 is a perspective view of known apparatus in which the film unit of FIG. 1 is suitable for use;

FIGS. 9–13 are partial perspective and front elevational views depicting the method of operation of the film unit of FIG. 1 in the apparatus of FIG. 8.

DESCRIPTION OF THE PREFERRED EMBODIMENT

Referring now to the drawings, and especially to FIGS. 1–6, a photographic film unit 8 is depicted in accordance with a preferred embodiment of the present invention as including a picture unit 10, dark slide 12 and leader arrangement 14.

The picture unit includes first and second sheets coupled along their lateral margins 16, as in the preregistered integral film unit described in the "Background of the Invention". One of the sheets is a photosensitive element 18 including a plurality of light-sensitive layers 20, (FIG. 5) an opaque layer 22 and an image receiving layer 24 carried on a dimensionally stable transparent support 26. These and additional respective layers of the photosensitive element are known in the prior art and will not be described in detail. It should be recognized, however, that the radiation sensitive layers are suitable for recording a latent image that is processable to establish a visibly perceivable image. The opaque layer shields the sensitive layers from actinic or other radiation striking one face 28 of the picture unit, and the image receiving layer is adapted to receive the final image, which diffuses thereto through the opaque layer during processing.

The other of the sheets is a transparent cover sheet 30 which serves several functions including confinement of the processing composition to facilitate its distribution during processing. As will become more apparent from the following description, the cover sheet also confines the dark slide in proper position for its intended purpose in accordance with the present invention.

Reservoir means, including a chemical pod or pouch 32 (FIG. 2) and trap 34 (FIG. 4) are disposed at the leading and trailing end sections of the picture unit, respectively. The pouch is provided for supplying the processing composition for distribution between the photosensitive element and process sheet. The trap collects any excess of the composition from between the element and sheet.

The final print when it is formed in the image receiving layer, should have precisely established edges. For this purpose, an opaque mask 36 extends along the end sections and lateral margins of the picture unit to create an image frame which defines the perimeter of the final picture area. Preferably, the mask is of the internal type adhered to the photosensitive element facing the cover sheet. The mask also may be used for covering the pod and trap, such as by cutting a piece 38 for placement over the pod and by folding another piece 40 around the trap and cover sheet. In such case, the mask helps block light from entering between the sheets at the leading and trailing ends of the picture unit.

On top of the mask, opaque side rails 42 (FIG. 3) of known caliper are provided for spacing the mask and cover sheet to receive the dark slide. It is through the side rails and the mask that the cover sheet is secured with appropriate adhesives to the photosensitive element. The combined mask and side rails also prevent light from entering between the sheets at the lateral margins of the picture unit.

The leader arrangement includes a flexible but somewhat stiff leader 44 overlapped with and attached to the leading end of the photosensitive element to facilitate handling of the film unit in cooperating apparatus as described more fully hereinafter. Saddle detents or shims 46 and 48 are provided at the lateral edges of the leader for similar purposes.

The internal dark slide 12 is positioned between the photosensitive element and cover sheet and cooperates with the opaque layer on the opposite side of the radiation sensitive layers to encase the sensitive layers and shield them from premature exposure. Thus, a single film unit can be handled in daylight without fogging. The dark slide has a length which is sufficient to extend from, beginning at the trailing end section of the picture unit, to beyond the leader where it will be natural to grasp the dark slide rather than the leader whenever the dark slide is present. The dark slide covers the entire image frame and extends therebeyond to overlap the mask around the entire perimeter of the final-image area. Moreover, the caliper of the dark slide is chosen so it will be confined and occupy the space between the mask and the cover sheet.

Figure 2:
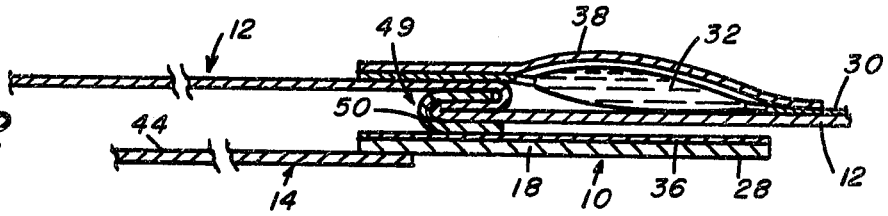
FIGS. 2–4 are cross-sectional views of the film unit of FIG. 1 taken as identified in FIG. 1 and illustrating internal features at the ends and edges of the film unit.
Figure 3:
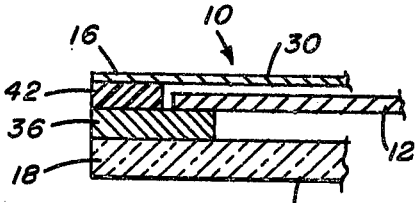
Figure 4:
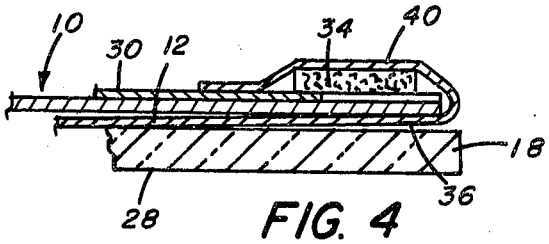
Figure 5:
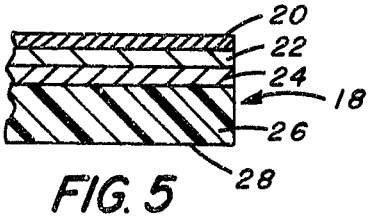

Referring now more specifically to FIGS. 2, 6, and 7, the light seal 49 includes a flexible strip of opaque material 50 having first and second ends or body and flap portions, 51 and 52 (FIG.7), respectively, and predetermined length and width dimensions. The strip is adhered to the photosensitive element, or actually to a mask on the element, and is interleaved with or folded into the dark slide so that pulling on the slide will straighten and release the strip from the dark slide. The length of the strip and the point of its attachment to the photosensitive element are chosen so the strip will lie flat against the element in its straightened condition without extending beyond the leading end of the element. The width is selected to match the width of the photosensitive element and provide an adequate light seal.

The strip and dark slide are maintained in their interfolded condition by pinching pressure from the photosensitive element and process sheet; or, if a more secure device is desired, the strip can be sealed to the element and sheet in their lateral margins 53, 54.

Notches 55 and 56 (FIG. 6) also may be provided in the flap portion of the strip for facilitating the proper folding progression of the strip and dark slide as the later is pulled from the film unit. The notches also may interact with the side rails for improving the light seal in the corners.

Figure 9:
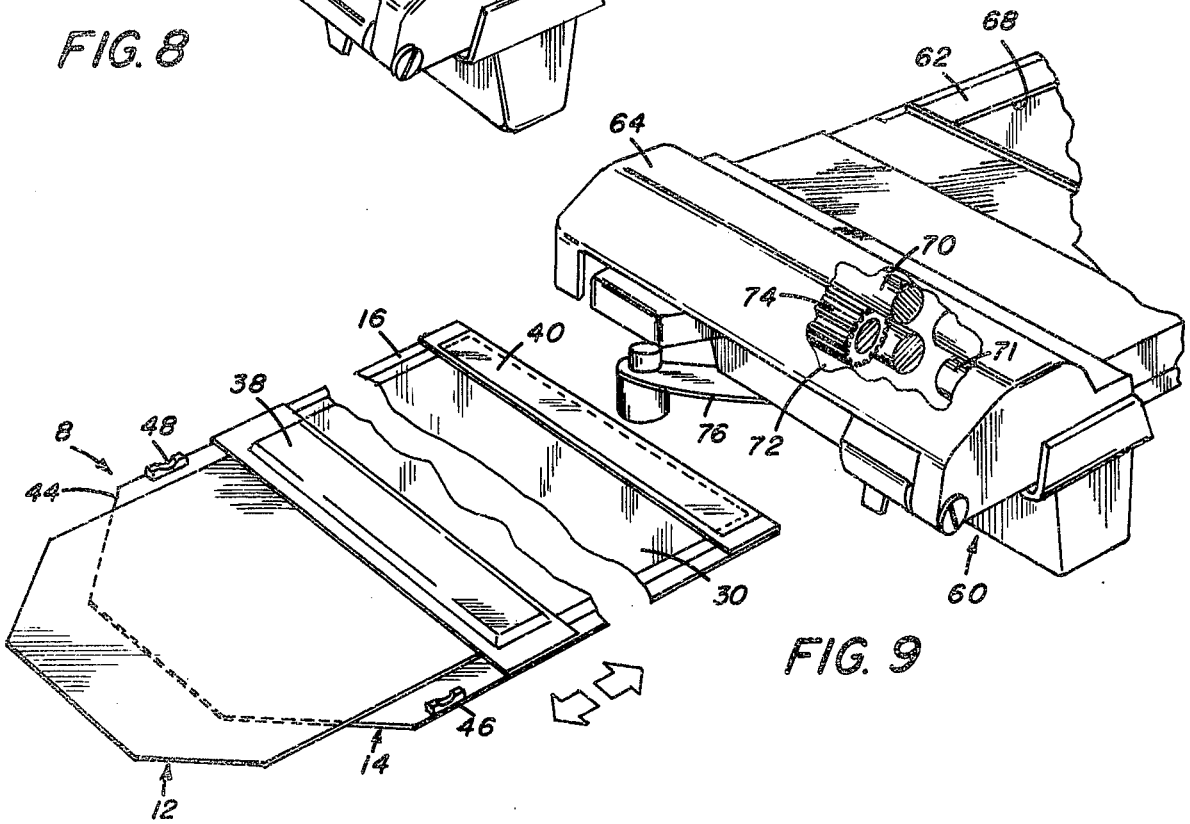
Figure 10:
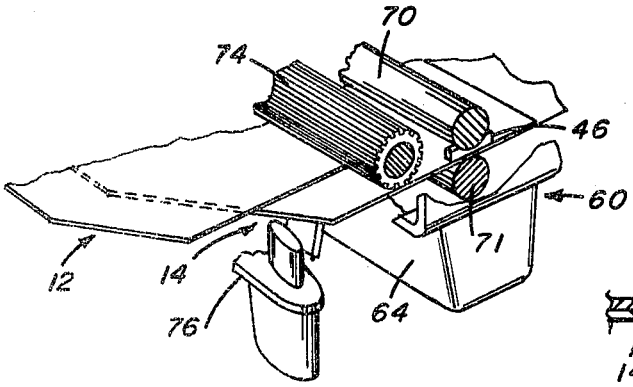
Figure 11:
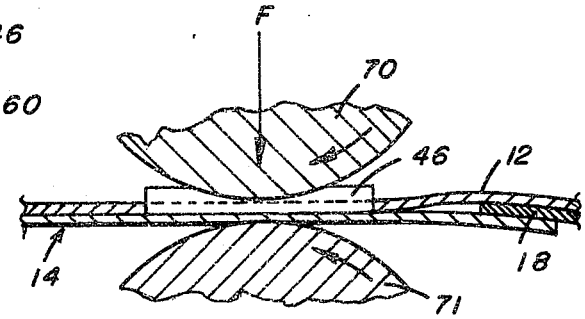
Figure 12:
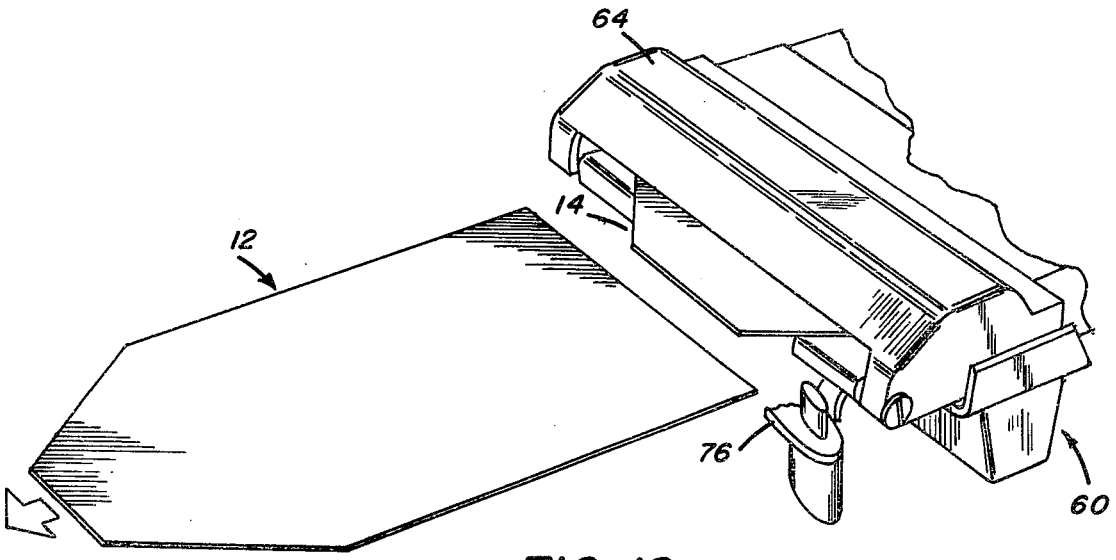

Referring now more specifically to FIGS. 8–13, the operation of the film unit is depicted with known apparatus. The apparatus comprises a camera-back adapter 60 of a type available commercially, including a body portion 62, and a processing section 64. The body portion defines a cavity for receiving individual ones of the film units and an exposure aperture 68 through which film units in the cavity are adapted to be exposed. The processing section includes a pair of pressure applying members 70, 71 (FIG. 9) and a passageway 72 which passes between light blocking means 74. A latch 76 partially shown in FIGS. 9 and 10 is moveable from an open or loading position (FIG. 9) where the pressure applying members are spaced-apart, and a closed or processing position (FIG. 10) where the members are urged together prior to initiating processing.

Figure 13:
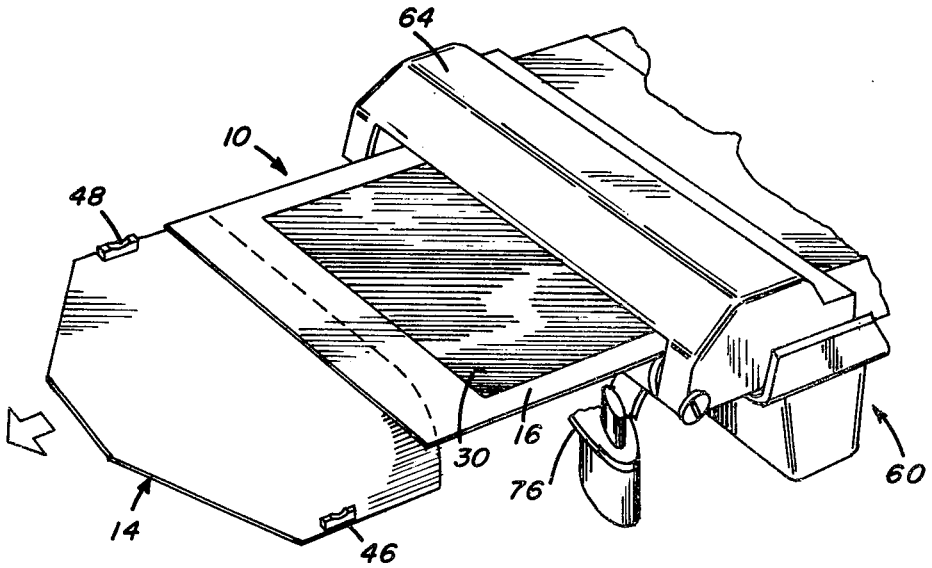

In operation, and referring first to FIG. 9, the latch 76 is moved to the open position, and the film unit is inserted through passageway 72 between the pressure applying members and into the cavity behind aperture 68. Suitable means, not shown, support the film unit in a substantially flat condition suitable for exposure. The latch 76 is closed and releases the pressure members which drop onto saddle detents 46 and 48 to hold the film unit in its proper operative position. The detents also may act as lifters to relieve some of the pressure of the members 70, 71 from the dark slide. The dark slide is then removed by grasping its leading end and pulling the slide (FIG. 12) entirely from the film unit and apparatus. This uncovers the photosensitive element and its light-sensitive layers for exposure. After exposure of the film unit, leader 44, uncovered by removal of the dark slide, is pulled to initiate processing and remove the film unit from the apparatus (FIG. 13). This distributes the processing composition from the pod between the photosensitive element and cover sheet. Assuming the composition includes an opacifier, as is common in integral film units, distribution of the composition establishes another opaque layer which cooperates with the first opaque layer 22 to shield the film unit from further exposure and permit daylight processing. During processing image-wise distributions of dyes diffuse through the fitrst opaque layer 22, to the image-receiving layer 24, where the transferred image is visible from face 28 of the picture unit. Finally, if desired, the leader can be stripped from the picture unit which then becomes the final print.

It should now be apparent that the invention provides a superior light seal in a film unit having an internal dark slide. The seal will remain intact under expected conditions of use, can be used in apparatus where the seal will be inaccessible when the dark slide is removed, and offers little resistance to such removal.

Other advantages and additional features of the invention will be apparent from the above descriptions when read by those skilled in the art.

Although the invention has been described with particular reference to a preferred embodiment thereof, it will be readily understood that variations and modifications can be effected within the spirit and scope of the invention as described hereinabove and as defined in the appended claims.

We claim:

1. An instant-processing film unit having first and second sheets connected together along their lateral margins, and including means for containing a distributable processing liquid, one of said sheets comprising a photosensitive layer for recording a latent image processable by the liquid and an opaque layer, the other of said sheets comprising a transparent cover for said element, the opaque layer and the transparent cover lying on opposite sides of said photosensitive layer; said film unit comprising:

a removable dark slide positioned between said sheets and covering said photosensitive element for protecting said element from fogging by light passing through said cover sheet;

means defining a passage extending from between said sheets to the exterior of said sheets, said dark slide extending through said passage to a position where said dark slide is accessible for removal from its position covering said photosensitive element; and a light-seal at said passage for protecting said photosensitive element from light entering said passage, said seal including a strip of flexible, opaque sheet material, first means for coupling said sheet material to said dark slide, and second means for coupling said sheet material to said photosensitive element, at least one of said first and second coupling means being releasable by removal of said dark slide.

2. A film unit as set forth in claim 1 wherein said strip includes a portion pinched between said sheets at the lateral margins of said sheets.

3. An instant-processing film unit including a reservoir for processing composition, a photosensitive element including at least one layer for recording a latent image processable by the composition to establish a visible image, and a transparent cover sheet attached to said photosensitive element for facilitating distribution of the processing composition between said element and sheet, the photosensitive element including an opaque layer on the opposite side of the recording layer from the cover sheet; said film unit comprising:

a dark slide positioned between said element and sheet and protecting said element from light passing through said sheet, said dark slide extending from between said element and sheet for removing said dark slide from said film unit; and a light-seal between said dark slide and said element, where said dark slide extends from between said element and sheet, said seal including a strip of flexible sheet material having a body portion coupling with said element and a flap portion coupling with said dark slide, one of said body portion coupling and said flap portion coupling being releasable by removing said dark slide from said film unit.

4. A film unit as set forth in claim 3 wherein said strip is folded back upon itself between said body portion coupling and said flap portion coupling.

5. A film unit as set forth in claim 3 wherein said strip and said couplings are confined entirely between said element and sheet.

6. A preregistered, instant-processing film unit having an end section and including a reservoir for processing composition, a photosensitive element including a layer for recording a latent image processable by the composition to establish a visible image, and a transparent cover sheet coupled to said photosensitive element for facilitating distribution of the processing composition over said element, the photosensitive element including an opaque layer opposite the recording layer from the cover sheet; said film unit comprising:

an internal dark slide removably positioned between said element and sheet for shielding said photosensitive element from light passing through said sheet, said dark slide extending from between said element and sheet at the end section; and a light-seal including a strip of flexible sheet material interfolded with said dark slide and coupled to said photosensitive element for preventing fogging of said photosensitive element by light passing between said photosensitive element and said dark slide at said end section.

7. In an instant-processing film unit including a container for processing composition, a photosensitive element including a radiation sensitive layer and an opaque layer, a transparent cover sheet attached to said photosensitive element on the opposite side of the radiation sensitive layer from the opaque layer, and a dark slide removably positioned between said photosensitive element and said cover sheet and shielding said photosensitive element from exposure through said cover sheet, said photosensitive element and said cover sheet defining an end section, and said dark slide extending from between said element and sheet at said end section; the improvement comprising:

a light seal between said photosensitve element and said dark slide at said end section, said light seal including an opaque strip coupled to said photosensitive element and to said dark slide, at least one of said couplings being releasable by removing said dark slide.

* * * * *